US005156569A

United States Patent [19]

Muller et al.

[11] Patent Number: 5,156,569

[45] Date of Patent: Oct. 20, 1992

[54] CEILING OUTLET

[75] Inventors: Gottfried Muller; Paul Hipp, both of Kolbingen, Fed. Rep. of Germany

[73] Assignee: Schako Metallwarenfabrik Ferdinand Schad KG, Kolbingen, Fed. Rep. of Germany

[21] Appl. No.: 737,269

[22] Filed: Jul. 29, 1991

[30] Foreign Application Priority Data

Aug. 25, 1990 [DE] Fed. Rep. of Germany ..... 4026932

[51] Int. Cl.[5] ..... F24F 13/06

[52] U.S. Cl. ..... 454/297; 454/304; 454/308

[58] Field of Search ..... 98/40.1, 40.11, 40.12, 98/40.13, 40.17, 114, 110, 121.2; 454/308

[56] References Cited

U.S. PATENT DOCUMENTS 2,557,502 6/1951 Goettl ..... 98/121.2 X
4,163,416 8/1979 Kurrle et al. ..... 98/40.17

FOREIGN PATENT DOCUMENTS 2254396 5/1974 Fed. Rep. of Germany ..... 98/114

*Primary Examiner*—Harold Joyce
*Attorney, Agent, or Firm*—Bachman & LaPointe

[57] ABSTRACT

A ceiling outlet and process for producing same is provided with outlet slits and air deflector slats for blowing supply air from an air-guide system into a room, wherein mountings for holding slats are bent in a metal sheet, a steel plate or a plate of another material.

15 Claims, 1 Drawing Sheet

CEILING OUTLET

The invention relates to a ceiling outlet with outlet slits and air deflector slats for blowing supply air from an air-guide system into a room and to a process for producing this.

Ceiling outlets of this type are known and are widely available on the market. Such outlets differ, above all, in their shape, size and the arrangement of the slits and of the slats deflecting the airstream.

Thus, for example, there are round or angular outlets, outlets in which the outlet slits are arranged circularly, in a row or the like, and outlets with fixed and with adjustable air deflector slats.

However, all these types of outlets are similar in terms of their basic design, especially their mode of construction.

Outlet slits are punched in a desired and so fixed arrangement in a metal sheet, a steel plate or a plate of another material which is cut to the contours of the subsequent ceiling outlet. For securing movable air deflector slats in particular, after the punching-out operation appropriate mountings are provided by welding, adhesive bonding, screwing, clamping or the like. Such mountings preferably consist of small plates which have bores or the like as receptacles for axles, especially for holding tubes, about which the air deflector slats are fastened rotatably. Such plates are produced in a separate operation, preferably by appropriate punching, the receiving orifices for the holding tubes being formed in the same work step or in a further work step, depending on the particular tool.

For the sake of an outlay in terms of time, material and labor which is lower in comparison with other procedures, these plates, together with the air deflector slats, are preferably mounted in the outlet slits by clamping. Such holding plates are somewhat wider than the outlet slit for which they are provided. In a lower region, they possess on each of the two sides a slot of equal length extending from the outside inwards, the width of the slot corresponding to the thickness of the metal sheet, steel plate or plate of another material. The part remaining between the slots has a width which itself corresponds to the width of the outlet slit.

Small plates of this type are introduced longitudinally into the outlet slits in the plane of the slot and by rotation are guided over the metal sheet by means of the slots until they are at right angles to the outlet slit. The axles or holding tubes together with the slats are mounted in the receiving orifices.

Despite this relatively rapid assembly, considerable disadvantages can be seen.

On the one hand, parts of these holding plates project from the plane of the front plate on the other side of the slats, thus leading to considerable problems, for example in maintenance and cleaning work, on such outlets. They prevent a suction nozzle, for example of a vacuum cleaner, from being placed flat against them, and they therefore make appropriate thorough cleaning not only more difficult, but virtually impossible, unless a disproportionately large amount of time is spent on this.

On the other hand, because of the material thickness used and as a result of their processing, these small plates are relatively sharp, so that a person can easily cut himself on them.

Moreover, the holding plates have to be additionally lacquered, this involving a considerable outlay in terms of labor and an appreciable environmental pollution.

Ceiling outlets of this type thus display considerable disadvantages both in respect of production and with regard to maintenance and cleaning.

The inventor's set object was to provide a ceiling outlet which can be handled easily during use, especially in maintenance work, and which is produced in a process which is cost-effective, environmentally safe and energy-saving.

To achieve this object, mountings for holding slats are stamped in a metal sheet, a steel plate or a plate of another material.

Production requires a metal sheet, a steel plate or a plate of another material which corresponds in its contours to the shape of the subsequent ceiling outlet, as much material being allowed at the edges as is necessary for the subsequent bending of the edge sides.

This sheet is then punched and its corners removed, tongues projecting the clear width of the outlet slit being left at the respective ends during the punching out of the outlet slits. Whereas the outlet slits can be of quite different lengths, the tongues left in them are preferably each of the same size. During the same work step, that is to say during the punching of the outlet slits and the removal of the corners, receiving orifices for the holding tubes of the air deflector slats, serving as slat axles, are to be made in these tongues.

The abovementioned tongues can be angular, but can also have a rounded triangular shape, although this necessitates a high outlay for the production of appropriate tools.

In this work step, a specially designed punching tool allowing a very rapid mode of operation is employed.

In a second work step, by means of a special stamping tool the tongues with the receiving orifices are bent preferably at right angles. The tongues are thus projecting at right angles and having the receiving orifices form the respective mountings for the axles of the air deflector slats. Preferably in the same work step, the edge sides are also bent about bending lines which correspond to the contours of the finished ceiling outlet.

The slats or the holding tubes together with the slats rotatable about them can easily be mounted and fixed in these mountings, a slat simply being inserted between two tongues and the holding tube being pushed through the tongues or slats.

The advantage of a ceiling outlet of the abovedescribed type is that it has no projections at the front, so that it can easily be cleaned with a nozzle of a vacuum cleaner. Because the nozzle can be placed flat onto it, even dirt inside the outlet slits is removed easily. In comparison with the use of holding plates clamped by means of slots, there is no danger of injury.

A further important advantage of such a ceiling outlet is, above all, the saving of work steps. Holding plates have neither to be punched nor additionally lacquered. Likewise, there is no need for the corresponding mounting of the holding plates on the previously slit metal sheet.

Since the outlets of the abovementioned type are in one piece before the slats are introduced, they can be powder-coated complete, thus making an expensive and environmentally unsafe spray lacquering superfluous.

Ceiling outlets of this type are square or round or can be produced in any other shape.

In general, such a process for the production of ceiling outlets results in an enormous cost and energy saving. The cost saving is achieved by the time saving resulting from the avoidance of work steps; the energy saving is obtained as a result of the omission of possible welding work, but above all the omission of separate punchings and lacquerings of holding plates or punchings of slots in these holding plates.

Further advantages, features and details of the invention emerge from the following description of preferred exemplary embodiments and from reference to the drawing; in this:

FIG. 1 shows a plane metal sheet R, steel plate or plate of another material in the punched state with corners removed.

Figure 1:
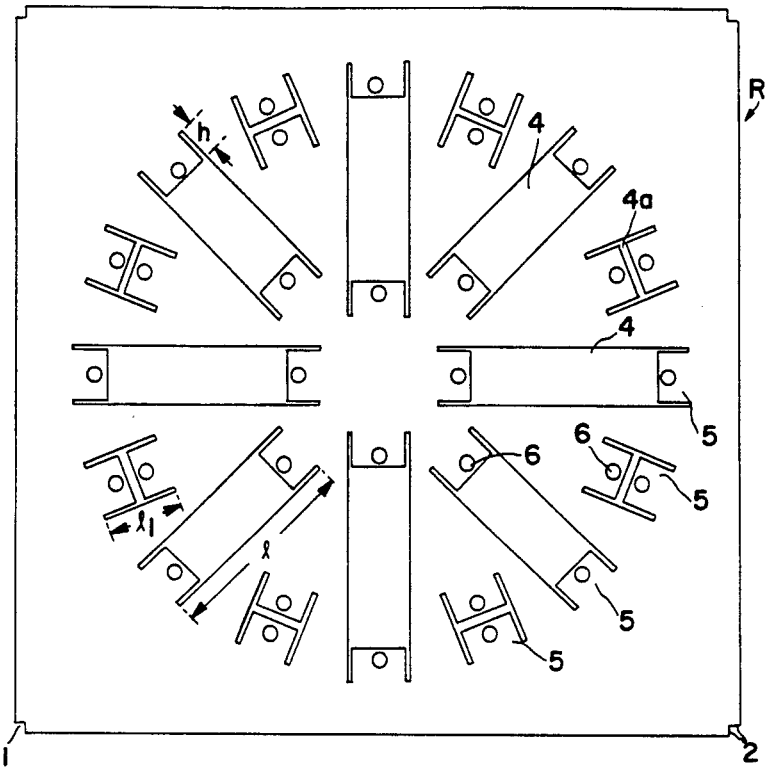
FIG. 1 shows a top view of a slit metal sheet which has had its corners removed and which is machined to form a ceiling outlet.
Figure 2:
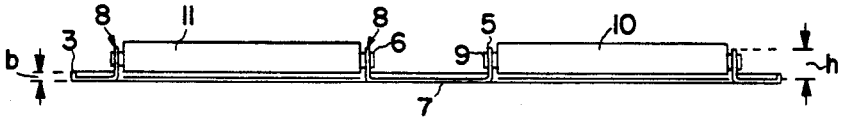
FIG. 2 shows a cross-section through a finished ceiling outlet along the line II—II according to FIG. 3.
Figure 3:
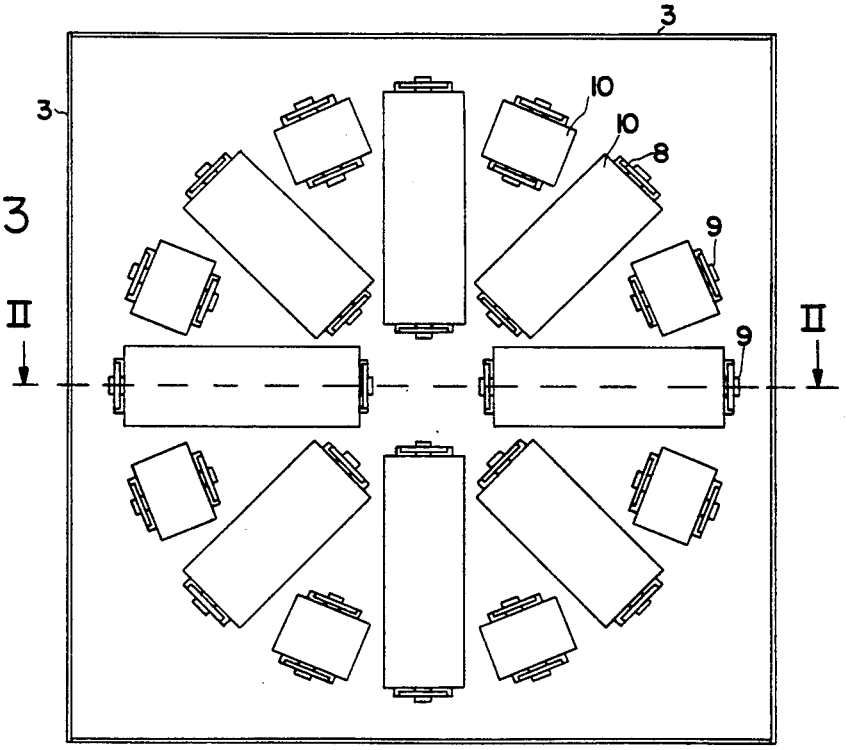
FIG. 3 shows a plan view of a finished ceiling outlet.

Upon removal of the corners, corner pieces 1 of the same size and equal-sided are notched out of the sheet at its four corners, the sides 2 having a length which corresponds to the width b of subsequently bent edge sides 3 according to FIG. 2.

By punchings, outlet slits 4 and 4*a* are made in the metal sheet R, preferably angular tongues 5 located opposite one another in the outlet slits being left respectively at both ends in the outlet slits 4 and 4*a*. Whereas the outlet slits 4 and 4*a* of a ceiling outlet can have different lengths 1 or $1_1$, as desired or required, the tongues 5 always have the same length which corresponds to the subsequent height h.

In the same work step, receiving orifices 6 are made in the tongues 5.

In a second work step, by means of a special tool (not shown) the tongues are then bent at right angles or set vertically in the opposite direction to a side 7 facing the room and together with the ceiling orifices 6 form respective mountings 8 for axles 11. These axles 11 are formed by fastening tubes 9.

The fastening tubes 9 pass respectively through mutually opposed tongues 5 or their receiving orifices 6 and are secured there by means of corresponding stampings or widenings. In the position of use, the fastening tubes 9 pass through slats 10 which rotate about the fastening tubes 9. The outflowing airstream can be influenced by an appropriate rotation of the slats 10.

The edge sides 3 are also bent preferably in the same work step as the erection of tongues 5.

We claim:

1. A process for producing a ceiling outlet with outlet slits and air deflector slats for blowing supply air from an air-guide system into a room, which comprises: providing a sheet in the size essentially of a ceiling outlet; removing the corners of said sheet; punching outlet slits from said sheet, said slits having ends; providing a tongue projecting into the respective outlet slits from each end thereof; and bending said tongues to provide a mounting for slat axles.

2. Process according to claim 1 where said sheet is metal and where said tongues are bent at essentially right angles to said sheet.

3. Process according to claim 2 including the step of forming receiving orifices for slat axles in the tongues.

4. Process according to claim 3 wherein a slat axle is inserted and secured in the mounting formed by the tongues and receiving orifices, the axle being pushed through the slat inserted between the tongues.

5. Process according to claim 4 wherein said slat axles is a holding tube.

6. Process according to claim 2 including the step of bending edge sides from the metal sheet.

7. Process according to claim 2 including the step of powder-coating at least one of the slit metal sheet and ceiling outlet.

8. Ceiling outlet with outlet slits and air deflector slats for blowing supply air from an air-guide system into a room, which comprises: a single sheet having mountings thereon for holding slats, wherein said mountings are bent in said sheet and consist of mutually opposed tongues each with a receiving orifice; slats received between respective mounting tongues; and an axle in each case passing through a slat and connected to two mutually opposed mounting tongues.

9. Ceiling outlet according to claim 8 wherein said slat is metal.

10. Ceiling outlet according to claim 9 wherein said sheet is steel.

11. Ceiling outlet according to claim 9 wherein the slats are rotatable about their respective axle.

12. Ceiling outlet according to claim 11 wherein the axles are formed by a holding tube which passes through the receiving orifices of the tongues and are secured in said orifices.

13. Ceiling outlet according to claim 9 wherein said tongues are defined by outlet slits and wherein said tongues are bent at essentially right angles to said sheet.

14. Ceiling outlet according to claim 13 wherein at least some of the outlet slits have different lengths.

15. Ceiling outlet according to claim 9 wherein edge strips are formed on the sheet and wherein said edge strips are bent.

* * * * *